US005331984A

United States Patent [19]

Isagawa

[11] Patent Number: 5,331,984

[45] Date of Patent: Jul. 26, 1994

[54] DISHWASHER

[75] Inventor: Akira Isagawa, Tokyo, Japan

[73] Assignee: Kabushiki Kaisha Toshiba, Kawasaki, Japan

[21] Appl. No.: 43,926

[22] Filed: Apr. 8, 1993

[30] Foreign Application Priority Data

Apr. 8, 1992 [JP] Japan ..... 4-086970

[51] Int. Cl.[5] ..... A47L 15/22; A47L 15/46

[52] U.S. Cl. ..... 134/57; 134/108

[58] Field of Search ..... 134/56 D, 57 D, 58 D, 134/105, 108

[56] References Cited

U.S. PATENT DOCUMENTS 3,847,666 11/1974 Jacobs ..... 134/108 X 3,923,073 12/1975 Jacobs ..... 134/108 X

FOREIGN PATENT DOCUMENTS 0483466 5/1992 European Pat. Off. ..... 134/57 D 2275116 1/1976 France .

*Primary Examiner*—Philip R. Coe

*Attorney, Agent, or Firm*—Cushman, Darby & Cushman

[57] ABSTRACT

A dishwasher includes a heater to heat water in a liquid containing portion, and a washing pump which circulates the water through a spray and the liquid continuing portion. A thermistor to detect the temperature of the heated water, is located on the liquid containing portion. A controller actuates the heater continuously and actuates the washing pump intermittently in a washing operation until the water temperature reaches a predetermined temperature.

11 Claims, 3 Drawing Sheets

DISHWASHER

BACKGROUND OF THE INVENTION

A prior dishwasher is disclosed in U.S. Pat. No. 4,172,463. In the '463 dishwasher, a chamber for receiving dishes to be washed is provided within an outer case. Water is collected in a liquid container at a bottom portion of the chamber. Water is sprayed onto the dishes by a pump. Sprayed water is returned to the liquid container to be recycled. A heater is located in the liquid container. During washing the heater heats the water and during drying the heater heats air to dry the dishes efficiently.

In this type of dishwasher, however, when water is circulated by the pump, a water level in the liquid container may become lower than the position of the heater. As a result, water in the liquid container is not heated efficiently by the heater, so that much time is required to heat water to a predetermined temperature suitable for washing the dishes. Therefore, it takes much time to wash the dishes.

Another known dishwasher includes a sensor for detecting the temperature of the water. Until the temperature of the water reaches a predetermined temperature, the pump is stopped so that much time is not required to heat the water. However, this causes a different problem.

Since the water is not sprayed to the dishes for a while from the beginning of the washing operation, refuse on the dishes becomes dried and tends to stick to dish surfaces. Therefore, it is not easy to remove the refuse from the dishes.

SUMMARY OF THE INVENTION

It is an object of the present invention to provide a dishwasher which can heat water in the chamber efficiently so that the dishes can be cleaned and dried easily.

It is another object of the present invention to provide a dishwasher which can minimize the operation time thereof.

In order to achieve the above objectives of the present invention, there is provided a dishwasher comprising:

a) a chamber having a portion for containing dishes or the like;

b) a liquid containing portion located on the bottom of the chamber for containing water;

c) heating means, located in the liquid containing portion for heating the water;

d) spray means, for spraying the water to the dishes or the like;

e) a washing pump, connected to the liquid containing portion and the spray means, for supplying the water from the liquid containing portion to the spray means, so that the water is circulated through the chamber, the liquid containing portion and the spray means;

f) temperature detecting means for detecting temperature of the water in the chamber; and g) control means, responsive to the temperature detecting means, for actuating the heating means, and for actuating the washing pump intermittently, until the temperature detected by the temperature detecting means reaches a predetermined temperature in a beginning of a washing operation.

DESCRIPTION OF THE PREFERRED EMBODIMENT

Figure 2:
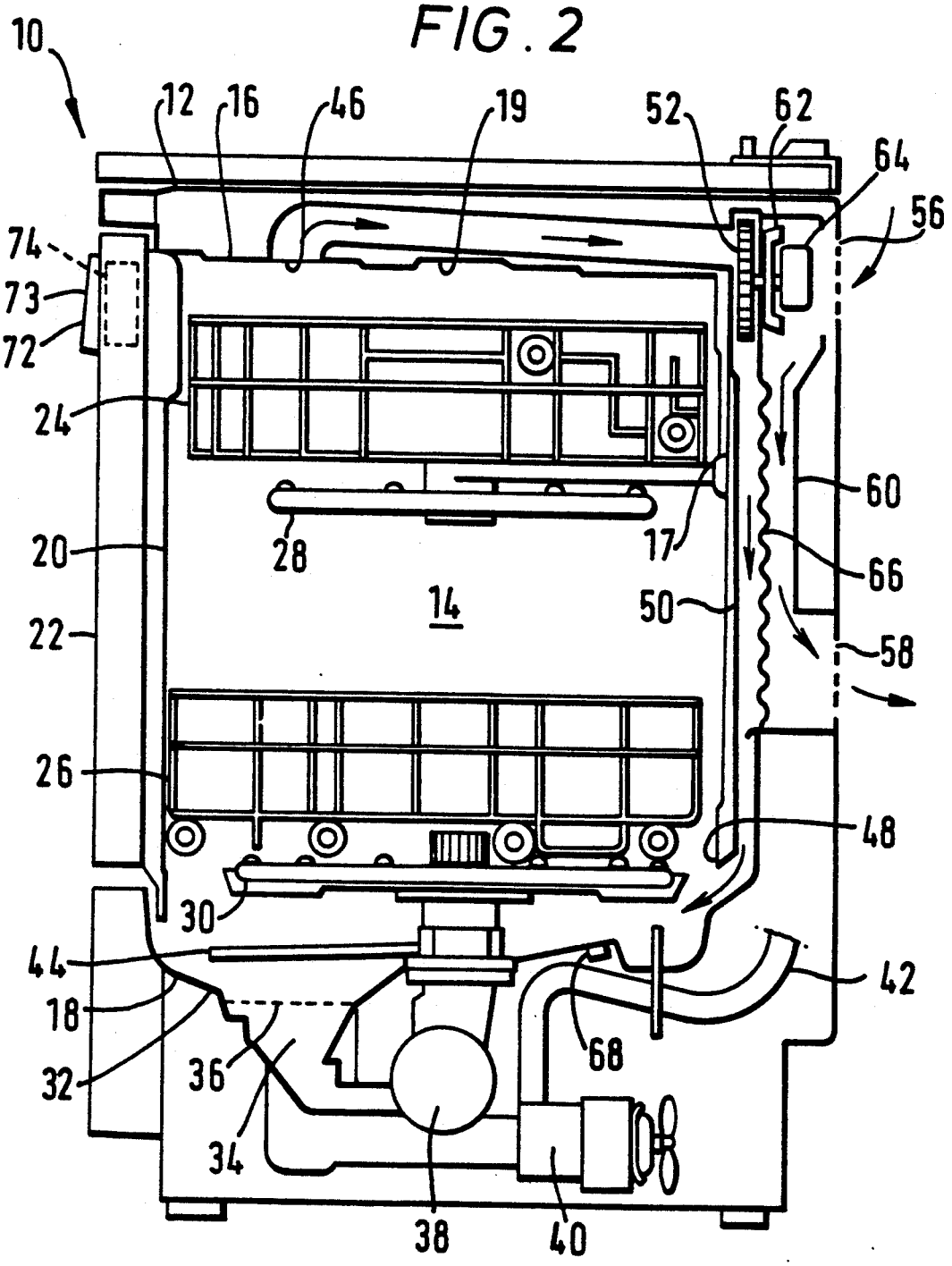
FIG. 2 is a vertical section of the dishwasher.

An embodiment of the present invention will now be described. With reference to FIG. 2, a dishwasher 10 comprises of an outer case 12 that surrounds a chamber 14 which is defined by an inner case 16 having a rear wall 17, a bottom 18 and a ceiling 19. Chamber 14 has a front opening 20. A door 22 which opens and closes the opening 20 is pivotally mounted against the opening 20. Within the chamber 14 are located an upper rack 24 and a lower rack 26 for holding the dishes or the like, movable into and out of the chamber 14 through the opening 20. An upper spray arm 28, located under the under the lower rack 26, sprays water onto the dishes or the like held in the racks 24 and 26 during a washing operation and a rinse operation. There is formed on bottom 18 of chamber 14*a* liquid containing portion 32. A depression 34 is formed on the bottom 18, which connects to the liquid containing portion 32 through a filter 36. A washing pump 38, which supplies the water in the liquid containing portion 32 to the spray arms 28 and 30 through the depression 34, is located under the bottom 18. A drain pump 40 which drains the water out through a drain pipe 42, is connected to the depression 34. A heater 44 is positioned in the liquid containing portion 32, so that the heater is submerged when the water is supplied. The heater 44 heats the water during washing and rinsing operations. The heater 44 heats air within the chamber 14 during drying operation. An air outlet 46 is formed on the ceiling 19. An inlet 48 is formed on the rear wall 17. The outlet 46 and the inlet 48 are connected by a duct 50, in which a first fan 52 which circulates the air in the chamber 14, is located.

On a rear plate of the outer case 12 are located a drawing port 56 and a exhausting port 58 for outside air, which are connected by a passage 60. A second fan 62 and a motor 64 which drives both of the first fan 52 and the second fan 62, are located in the passage 60. The second fan 62 draws outside air through the drawing port 56, and exhausts the outside air through the exhausting port 58. A heat exchanger 66 is located between the duct 50 and the passage 60.

During a drying operation, when the motor 64 drives the first fan 52 and the second fan 62, heat exchanger 66 causes heat to flow from air inside the chamber to the outside air so that moist air inside the chamber is dehumidified. Water condensed from the air runs into the depression 34 through the inlet 48. A thermistor 68, which is one part of a temperature detecting circuit 70 (FIG. 3) for the water in the liquid containing portion 32, is located on an outside of the bottom 18. Some operation switches 72 and a display 73 are positioned on a front surface of the door 22. A controller 74, connected to the operation switches 72, the display 73 and the thermistor 68, is positioned inside of the door 22.

Figure 3:
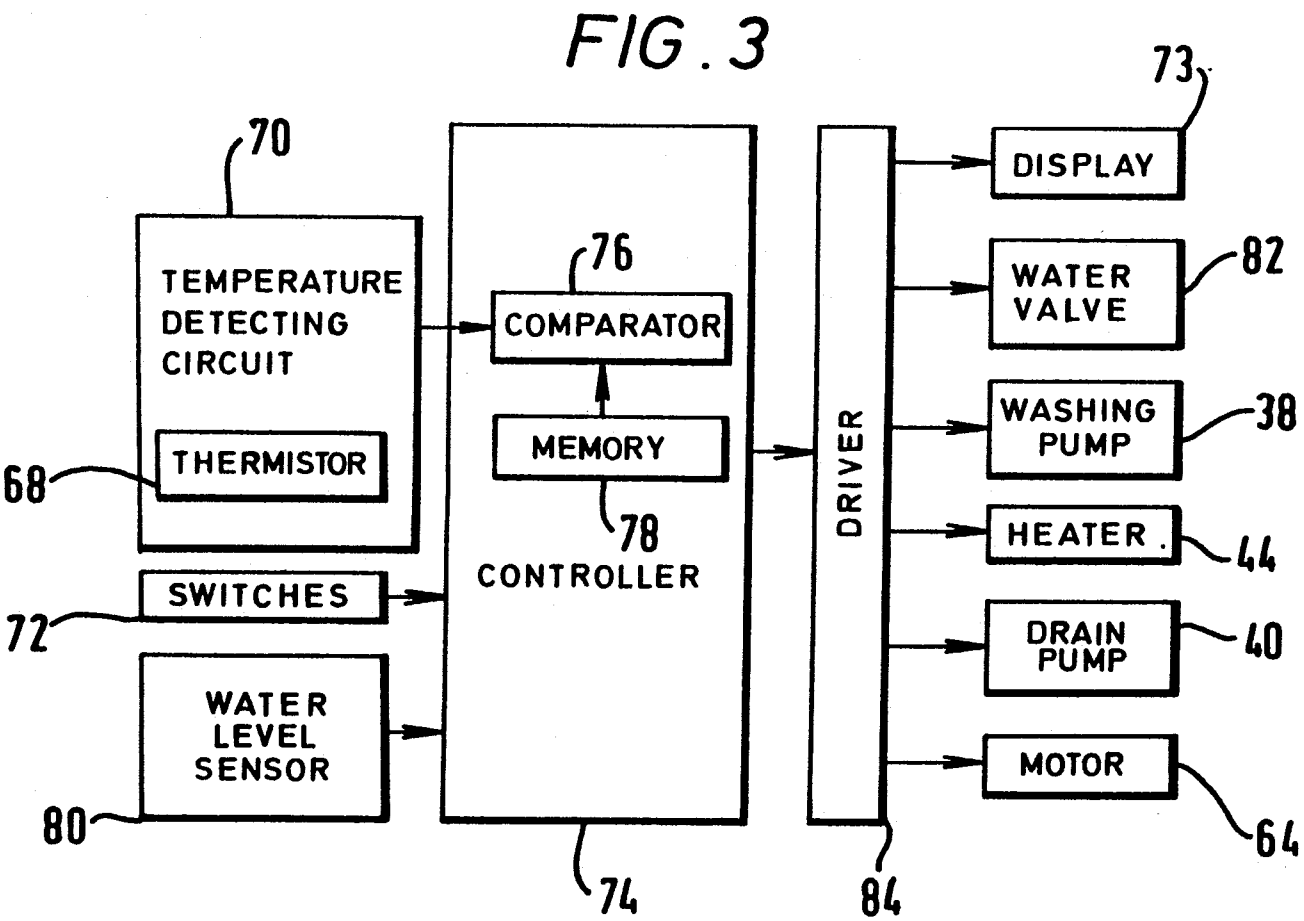
FIG. 3 is a block diagram showing an electrical arrangement of the dishwasher.

With reference to FIG. 3, the controller 74 comprises a microcomputer having a comparator 76 and a memory 78. The comparator 76 compares the temperature indicated by the temperature detecting circuit 70 with a predetermined temperature stored in the memory 78. A water level sensor 80 which detects the water level in the liquid containing portion 32 is coupled to the controller 74. A water valve 82 for supplying the water to the chamber 14 from a water supply, is connected to the controller 76 through a driver 84. The display 73, the washing pump 38, the heater 44, the drain pump 40 and the motor 64 are coupled in a parallel to the controller 74 through the driver 84.

Figure 1:
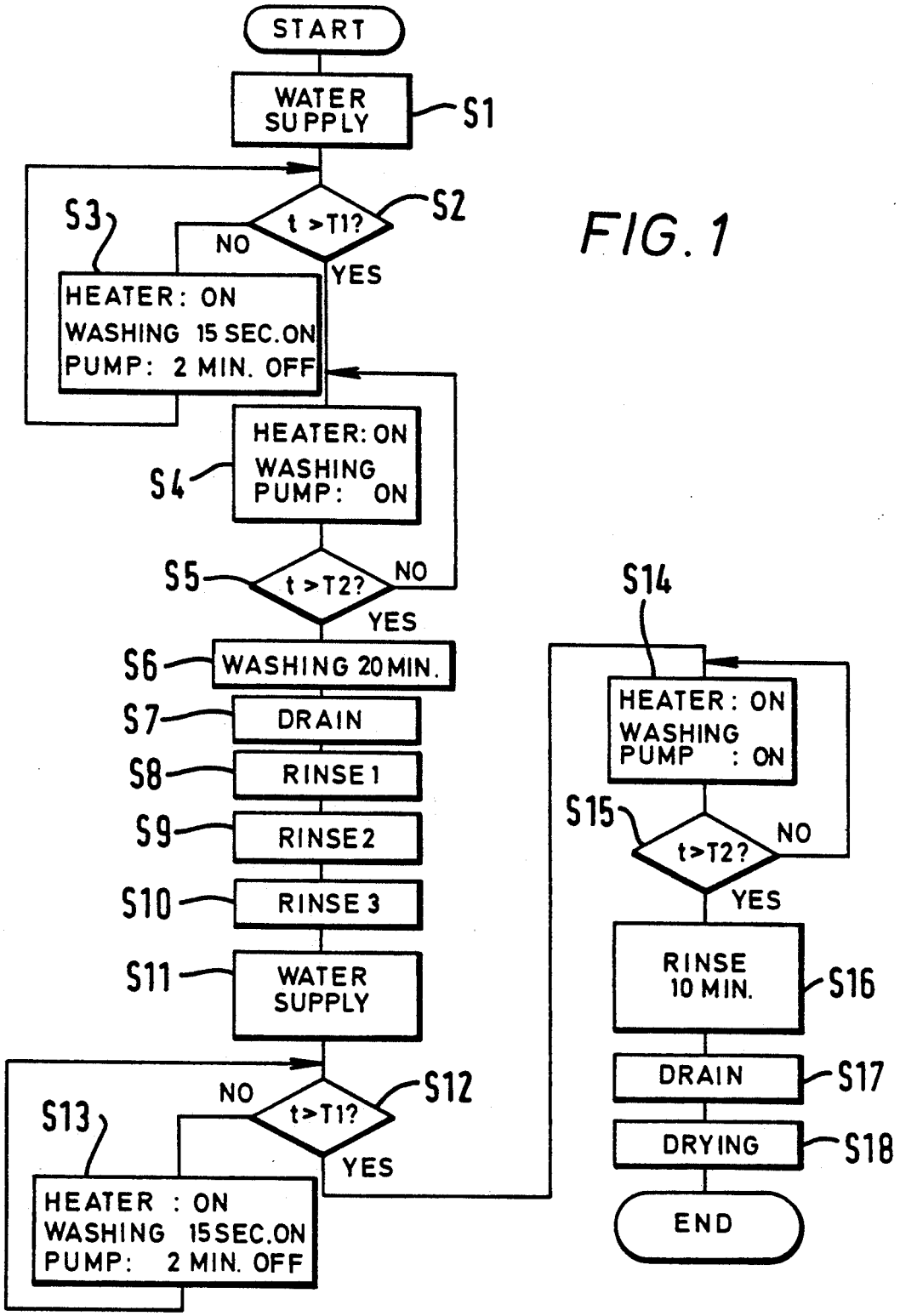
FIG. 1 is a flow chart showing operation of a dishwasher according to the present invention.

With reference to FIG. 1, the washing operation, the rinsing operation and the drying operation of the dishwasher 10 will be described as follows. When electric power is supplied, the controller 74 opens the water valve 82 through the driver 84 so that water is supplied into the liquid containing portion 32 of the chamber 14 (step S1). The water valve 82 is closed when the water level sensor 80 detects the predetermined water level of the water in the liquid containing portion 32. A temperature t° C. of the supplied water, which is detected by the temperature detecting circuit 70, is compared with the water temperature T1. T1 is set to 40° C. being a selected value in a preferred range of 40 to 45° C. When the temperature t° C. is greater than T1, the process goes to a next step S4. While when the temperature t° C. is not greater than T1, the heater 44 is turned on continuously and the washing pump 38 is actuated intermittently, such as a pattern of 15 seconds on and 2 minutes off (step S3). The above pattern is repeated until the temperature t° C. becomes greater than T1. In the operation (step S3) of the water pump 38 actuating intermittently, the water in the liquid containing portion 32 is sprayed to the dishes held in the racks 24 and 26 through the spray arm 28 and 30.

As a result, since the water level in the liquid containing portion 32 becomes low, the heater 44 is positioned above the water level. When the washing pump 38 is not actuated, the sprayed water is collected in the liquid containing portion 32. As a result, the water level rises to the same level it is at the beginning of the operation and the heater 44 is submerged. Therefore, the water is efficiently heated by the heater 44 and the water temperature t° increases faster.

In the step S2 returned from the step S3, when the temperature t° C. of the water is greater than T1, the heater 44 is turned on continuously and the washing pump 38 is actuated continuously (step S4). If the supplied water is hot water, the process progresses from the step S2 to the step S4 directly. When the heater 44 is turned on in the step S4, a temperature t° C. of the water is always detected by the temperature detecting circuit 70. The comparator 76 compares the temperature t° C. with a predetermined temperature T2. T2 is set to 60° C. being a selected value in a preferred value of 60° to 65° C. After the temperature t° C. is greater than T2 (step S5), the heater 44 is actuated in 20 minutes and is controlled so that the temperature t° C is in a range of 60° to 65° C. (step S6). After the step S6, the drain pump 40 is actuated so that the water collected in the liquid containing portion 32 is drained from the depression 34 through the drain pipe 42 (step S7). After the washing operation is completed, the rinse operations are operated three times (step S8 to step S10).

Then a last rinse operation of using heated water as follows is operated in sequence (step S11 to step S17). The water is supplied to the chamber 14 (step S11), the supplied water is heated by the heater 44. A temperature t° C. of the supplied water is detected by the temperature detecting circuit 70. The comparator 76 compares the water temperature t° C. and the predetermined temperature T1. When the temperature t° C. is greater than T1, the process progresses to the next step S14. While, when the temperature t° C. is not greater than T1, the heater 44 is turned on continuously and the washing pump 38 is actuated intermittently, such as the pattern of 15 seconds on and 2 minutes off (step S13), until the temperature t° C. becomes greater than T1.

In the step S14, the heater 44 is turned on continuously and the washing pump 38 is actuated continuously. When the heater 44 is turned on in the step S14, a temperature t° C. of the water is always detected by the temperature detecting circuit 70. The comparator 76 compares the temperature t° C. and the predetermined temperature T2. T2 is set to 60° C. being a selected value in a preferred value of 60° to 65° C. After the temperature t° C. is greater than T2, the heater 44 is actuated in 10 minutes and is controlled so that the temperature t° C. is in a range of 60° to 65° C. (step S16).

After the step S16, the drain pump 40 is actuated so that the water collected in the liquid containing portion 32 is drained from the depression 34 through the drain pipe 42 (step S17).

After the rinse operation is completed, the drying operation (step S18) is started for a predetermined time. The heater 44 is turned on continuously so that the air within the chamber 14 is heated. The motor 64 is actuated so that the first fan 52 and the second fan 62 are rotated. The heated air within the chamber 14 is sucked into the duct 50 through the outlet 46 and is returned to the chamber 14 through the inlet 48 due to the rotation of the first fan 52. The outside air is sucked into the passage 60 through the drawing port 56 and is exhausted from the passage 60 through the exhausting port 58. Since the heater 44 heats the air within the chamber 14, the water on the dishes is evaporated. The heated air absorbing the moisture in the chamber 14 is cooled by the outside air in the heat exchanger 66. Water drops are condensed from the heated air in the heat exchanger 66, the water flows to the liquid containing portion 32 through the inlet 48. The cooled air is reheated to dry the dishes. The air within the chamber 14 is circulated for a predetermined time.

At the beginning of the washing operation, the washing pump 38 is actuated intermittently and the heater 44 is turned on continuously until the temperature of the water becomes greater than the predetermined temperature. During the washing, pump 38 is not actuated; the water level rises and the heater 44 is submerged in the water. As the result, since the heater 44 heats the water efficiently, the time needed to heat the water is minimized so that the operation time is minimized.

Further, since the washing pump 38 is actuated at the beginning of the washing operation, refuse fixed on the dishes are wet. As a result, since refuse on the dishes are not dried, refuse fixed on the dishes are removed from the dishes easily. In the rinse operation of using heated water, since the dishes are sufficiently heated by the heated water, such as in a range of 60° to 65° C., for the predetermined time, the time needed to dry the dishes can be minimized. That's because that, if after the water would be heated up to the temperature T2 without the operation of the washing pump, the heated water contacts the dishes, then the heated water is cooled by the dishes and the temperature lowers suddenly. Therefore, when the heated air is supplied to the low temperature dishes, since the water temperature lowers suddenly, the dishes are not heated in the range of 60° to 65° C. for a predetermined time. More time is required to dry the dishes in the drying operation.

Although the washing pump is actuated intermittently in the rinse operation, the invention can be successfully practiced without the such operation of the washing pump in the rinse operation. T1 being the temperature in the washing operation is available if it is not the same temperature in the rinse operation, and the same statements are true for T2.

The foregoing disclosure and drawings are merely illustrative of the principle for the present invention and not to be interpreted in a limiting sense. The only limitation is to be determined from the scope of the appended claims.

What is claimed is:

1. A dishwasher comprising:

a) a chamber having a portion for containing articles to be cleaned;

b) a liquid containing portion located on the bottom of the chamber for containing water;

c) heating means, located in the liquid containing portion, for heating the water;

d) spray means for spraying the water to the articles to be cleaned;

e) a washing pump, connected to the liquid containing portion and the spray means, for supplying the water from the liquid containing portion to the spray means, so that the water is circulated through the chamber, the liquid containing portion and the spray means;

f) temperature detecting means for detecting temperature of the water in the chamber; and g) control means, responsive to the temperature detecting means, for actuating the heating means, and for actuating the washing pump intermittently, until the temperature detected by the temperature detecting means reaches a predetermined temperature at a beginning of a washing operation.

2. A dishwasher according to claim 1, wherein the control means includes compare means for comparing the temperature detected by the temperature detecting means and the predetermined temperature, the control means, when the compare means determines that the temperature detected by the temperature detecting means exceeds the predetermined temperature, controlling heating means so that the heating means is turned on, the control means actuating the washing pump intermittently.

3. A dishwasher according to claim 1, wherein the temperature detecting means is located on the bottom of the chamber.

4. A dishwasher according to claim 1, wherein the heating means is located in the liquid containing portion so that the heating means is submerged in the water when the actuation of the washing pump is being stopped.

5. A dishwasher according to claim 1, wherein the control means for actuating the washing pump continuously after the temperature detected by the temperature detecting means reaches the predetermined temperature.

6. A dishwasher according to claim 1, wherein the liquid containing portion includes a depression on the bottom of the chamber.

7. A dishwasher according to claim 1, wherein the predetermined temperature is in a range of 40° to 45° C.

8. A dishwasher according to claim 1, wherein the control means repeats the actuation of the washing pump in a predetermined cycle of an actuating time and a stop time, the stop time being longer than the actuating time, until the temperature detected by the temperature detecting means reaches the predetermined temperature in the beginning of the washing operation.

9. A dishwasher according to claim 8, wherein the actuating time is 15 seconds, and the stop time is 2 minutes.

10. A dishwasher according to claim 1, wherein the control means actuates the heating means, and actuates the washing pump intermittently, until the temperature detected by the temperature detecting means reaches a predetermined temperature in a rinse operation.

11. A dishwasher comprising:

a) a chamber having a portion for containing articles to be cleaned;

b) a liquid containing portion located on the bottom of the chamber for containing water;

c) a heater located in the liquid containing portion, for heating the water;

d) a sprayer for spraying the water to the articles to be cleaned;

e) a washing pump, connected to the liquid containing portion and the sprayer, for supplying the water from the liquid containing portion to the sprayer so that the water is circulated through the chamber, the liquid containing portion and the sprayer;

f) temperature detector for detecting temperature of the water in the chamber; and g) a controller, responsive to the temperature detector, for actuating the heater and for actuating the washing pump intermittently, until the temperature detected by the temperature detector reaches a predetermined temperature at a beginning of a washing operation.

* * * * *